US005231902A

United States Patent [19]

Uno et al.

[11] Patent Number: 5,231,902

[45] Date of Patent: Aug. 3, 1993

[54] PNEUMATICALLY OPERATED SCREW DRIVER

[75] Inventors: Akira Uno; Yasuyuki Hirano; Satoshi Kuno; Isamu Tanji; Yasuki Ohmori, all of Katsuta, Japan

[73] Assignee: Hitachi Koki Co. Ltd., Tokyo, Japan

[21] Appl. No.: 893,000

[22] Filed: Jun. 3, 1992

[30] Foreign Application Priority Data

Jun. 10, 1991 [JP] Japan ..... 3-137674
Jun. 12, 1991 [JP] Japan ..... 3-140137
Jan. 24, 1992 [JP] Japan ..... 4-010773

[51] Int. Cl.[5] ..... B25B 17/00

[52] U.S. Cl. ..... 81/57.44; 81/57.37; 173/159; 173/220

[58] Field of Search ..... 81/54, 57.37, 57.44, 81/430, 433, 435; 173/152, 154, 159, 220

[56] References Cited

U.S. PATENT DOCUMENTS 890,065 6/1908 Kellow ..... 173/159
2,383,380 8/1945 Gimpel ..... 173/159
2,818,893 1/1958 Shaff ..... 81/430
3,247,874 4/1966 MacDonald ..... 81/430
3,583,451 6/1971 Belvidere ..... 81/430

FOREIGN PATENT DOCUMENTS 64-45579 2/1989 Japan .

*Primary Examiner*—James G. Smith
*Attorney, Agent, or Firm*—Sughrue, Mion, Zinn, Macpeak & Seas

[57] ABSTRACT

A pneumatically operated screw driver having a pneumatically operated rotor rotatably supported in an outer frame. The rotor is only rotatable about its axis. A moving unit is slidably disposed within the rotor. The moving unit has an upper piston and is axially movable upon application of pneumatic pressure to the upper piston. The moving unit is also rotatable about its axis because of spline connection with the rotor. A valve is disposed for selectively applying the pneumatic pressure to the piston and to the rotor. Upon application of the pneumatic pressure, the moving unit is moved downwardly, and the pneumatic pressure is then introduced into the rotor for rotating the same. The rotation of the rotor is transmitted to the moving unit. The valve closes a fluid passage directing to the piston and to the rotor when the moving unit has the lowermost position.

23 Claims, 15 Drawing Sheets

PNEUMATICALLY OPERATED SCREW DRIVER

BACKGROUND OF THE INVENTION

The present invention relates to a pneumatically operated screw driver, and more particularly, to such driver capable of reducing consumption of compressed air and enhancing operability and durability.

A conventional pneumatically operated screw driver is disclosed in a Japanese Patent Application Kokai (OPI) No. Hei-1-45579. As shown in FIG. 1, the conventional driver generally includes a pneumatically rotatable rotor 1, a power transmission unit 3 driven by the rotor 1 for rotating a screw 13 about an axis thereof, a moving unit 14 slidably supported by an outer frame 7 and rotatably supporting the rotor 1 for downwardly depressing the rotating screw 13, and a screw supply unit 28 for successively supplying a screw below the power transmission unit 3.

More specifically, the conventional screw driver has the outer frame 7 in which the moving unit 14 is slidably disposed. In a hollow space of the moving unit 14, the rotor 1 is rotatably supported by support means 15 such as bearings fixed to the moving unit 14. The power transmission unit 3 including a drive bit is disposed coaxially with the rotor 1 and provided integrally therewith. Therefore, upon rotation of the rotor 1, the power drive bit is also rotated about its axis. A coil spring 11 is interposed between a lower end of the moving unit 14 and a bottom wall of the outer frame 7 for normally urging the moving unit 14 upwardly. On the bottom wall, a damper member 4 formed of a rubber is mounted to which the lower end of the moving unit 14 is abuttable for damping the moving energy of the moving unit 14.

At a lower portion of the screw driver, the screw supply unit 28 is provided. The screw supply unit 28 includes a supply piston 29, a coil spring 31, a feed pawl (not shown) and a linking band 33. The coil spring 31 is disposed within a piston chamber 29*a* for normally urging the supply piston 29 toward a position below the drive bit 3. The feed pawl is movably supported at a tip end of the feed piston 29 and engageable with a hole formed in the linking band 33 for supplying the screws 13 to the position immediately below the drive bit 3 in order to successively feed each one of the screws 13 to a position coaxially with the drive bit 3 and therebelow.

A fluid circuit is provided in the outer frame 7 for moving the moving unit 14 and the piston 29 and for rotating the rotor 1. That is, a compressed air inlet port 5 and outlet port 9 are provided in the frame 7. The inlet port 5 is connected to a compressed air source (not shown). These ports 5 and 9 are selectively communicatable with an operation valve 2 movable by a trigger 10 secured to the outer frame 7. A passage 16 extends from the operation valve 2. The passage 16 is in fluid communication with the piston chamber 29*a* for applying pneumatic pressure to the feed piston 29 to move the latter against the biasing force of the coil spring 31.

The passage 16 is also communicated with a top passage 8 for applying pneumatic pressure to a top surface of the moving unit 14 in order to move the latter downwardly against the biasing force of the coil spring 11. Further, the passage 16 is in fluid communication with an internal passage 18 within the moving unit 14 by way of a lateral bore 17 formed in a side wall of the moving unit 14 so as to introduce the compressed air into the rotor 1.

With this arrangement, when the trigger 10 is manipulated (pulled upwardly), the compressed air from the compressed air source is introduced into the passage 16 through the operation valve 2. Therefore, the compressed air is introduced into the internal passage 18 through the lateral bore 17, and reaches the rotor 1 for pneumatically rotating the same 1. Further, the compressed air is also introduced into the top passage 8 for applying pneumatic pressure at the top wall of the moving unit 14 for moving the latter downwardly against the biasing force of the coil spring 11.

By the rotation of the rotor 1, the power transmission unit 3 is also rotated in order to rotate the screw 13 about its axis, and at the same time, the screw 13 is moved downwardly by the downward movement of the moving unit 14. Thus, the screw 13 can be screwed into a workpiece 35 or a wall to be screw-fixed. During this time, the compressed air is also introduced into the screw supply unit 28, so that the feed piston 29 is moved to its retracted position (rightwardly in FIG. 1) against the biasing force of the coil spring 31.

Thereafter, if the trigger 10 is released, the compressed air supply to the top passage 8, the internal passage 18 and the screw feed unit 28 is blocked by the operation valve 2. Therefore, air in the top passage 8 is discharged outside through the outlet port 9. Accordingly, the moving unit 14 is moved upwardly by the biasing force of the coil spring 11 to restore its original position. Further, the compressed air in the screw supply unit 28 is also discharged outside through the outlet port 9, so that the feed piston 29 is moved toward the drive bit 3 by the biasing force of the spring 31. Accordingly, the screw 13 is supplied toward the position immediately below the drive bit 3.

As described above, according to the conventional screw driver, the power transmission unit 3 is provided integrally with the rotor 1, and the rotor 1 is rotatably provided within the moving unit 14. Here, generally, the rotor 1 must have a bulky size and has a heavy weight, and therefore, the moving unit 14 must also be bulky and heavy for accommodating therein the bulky rotor 1. Thus, entire weight of the conventional screw driver is almost occupied by the rotor 1 and the moving unit 14, and consequently, large reactive force may be provided at a time of screw driving operation, which may lower operability of the screw driver.

Further, due to the bulky size of the rotor 1 and the moving unit 14, the vertically moving stroke of the rotor 1 must also be large in addition to increase in diametrical direction thereof. Consequently, resultant outer frame 7 has large size, and therefore, entire screw driver must provide a bulky size, which in turn impedes operability of the screw driver.

In another aspect of the conventional screw driver, even after fixing of the screw 13 to the workpiece 35, the moving unit 14 is moved downwardly to abut against the damper member 4 due to surplus energy. In this case, large impact force may be generated due to heavy weight of the rotor 1 and the moving unit 14. This impact or repulsive force may be directly transmitted to the rotor 1 and to the rotor supporting members 15 to reduce durability or service life of the screw driver.

In still another aspect of the conventional screw driver, supply of the compressed air to the rotor 1 or a stop of the supply is performed by the opening and closing operation of the operation valve 2 by virtue of the manipulation to the trigger 10. In this case, an operator releases the trigger 10 for closing the operation valve 2 after his acknowledgement of completion of the fixing of the screw 13 with respect to the workpiece 35. Therefore, the compressed air may be uselessly supplied during a period from completion timing of the screw fixing to the release timing of the trigger 10. Accordingly, larger volume of the compressed air may be consumed.

In a recent building industry, light weight panel board such as a plaster staff is widely used, and accordingly, special types of screws for fixing such board are used in increasing amount. For this, demand has been made for using a light weight screw driver available for such screws. For the screw driving work, an electrical screw driver has been used. However, another screw driver such as a pneumatically operated screw driver having a light weight is demanded since the electrical screw driver is generally heavy. Still however, in an actual construction site, a compressor as the compressed air source must also be used in case of the employment of the pneumatically operated screw driver. The compressor must be portable and small in size, and in this connection, the above described pneumatically operated screw driver is not available, since the driver consumes large volumes of compressed air. Moreover, as described above, since the screw feed unit 28 is also pneumatically driven, the unit 28 consumes the compressed air. In view of the above, it is necessary to provide a pneumatically operated screw driver which can reduce consumption of the compressed air.

SUMMARY OF THE INVENTION

It is therefore, an object of the present invention to overcome the above described drawbacks, and to provide an improved pneumatically operated screw driver having a small size and capable of enhancing operability and durability as well as capable of reducing consumption of compressed air.

This and other objects of the present invention will be attained by providing a pneumatically operated screw driver connected to a compressed air source for driving a screw into a workpiece, the screw driver comprising an outer frame, a rotor, a moving unit, rotation transmitting means, and means for selectively introducing pneumatic pressure to the rotor and the moving unit. The outer frame is formed with a compressed air inlet port. The rotor is rotatably supported within the outer frame. The rotor is formed with a hollow space in an axial direction thereof, the rotor being only rotatable about its axis. The moving unit has a drive bit coaxially engageable with a screw and movable in an axial direction thereof. The moving unit is slidably disposed within the hollow space. The rotation transmitting means is disposed between the rotor and the moving unit for transmitting rotation of the rotor to the moving unit. The means for selectively introducing pneumatic pressure to the rotor and the moving unit is adapted for pneumatically rotating the rotor about its axis and for moving the moving unit in the axial direction.

DETAILED DESCRIPTION OF THE PREFERRED EMBODIMENTS

Figure 1:
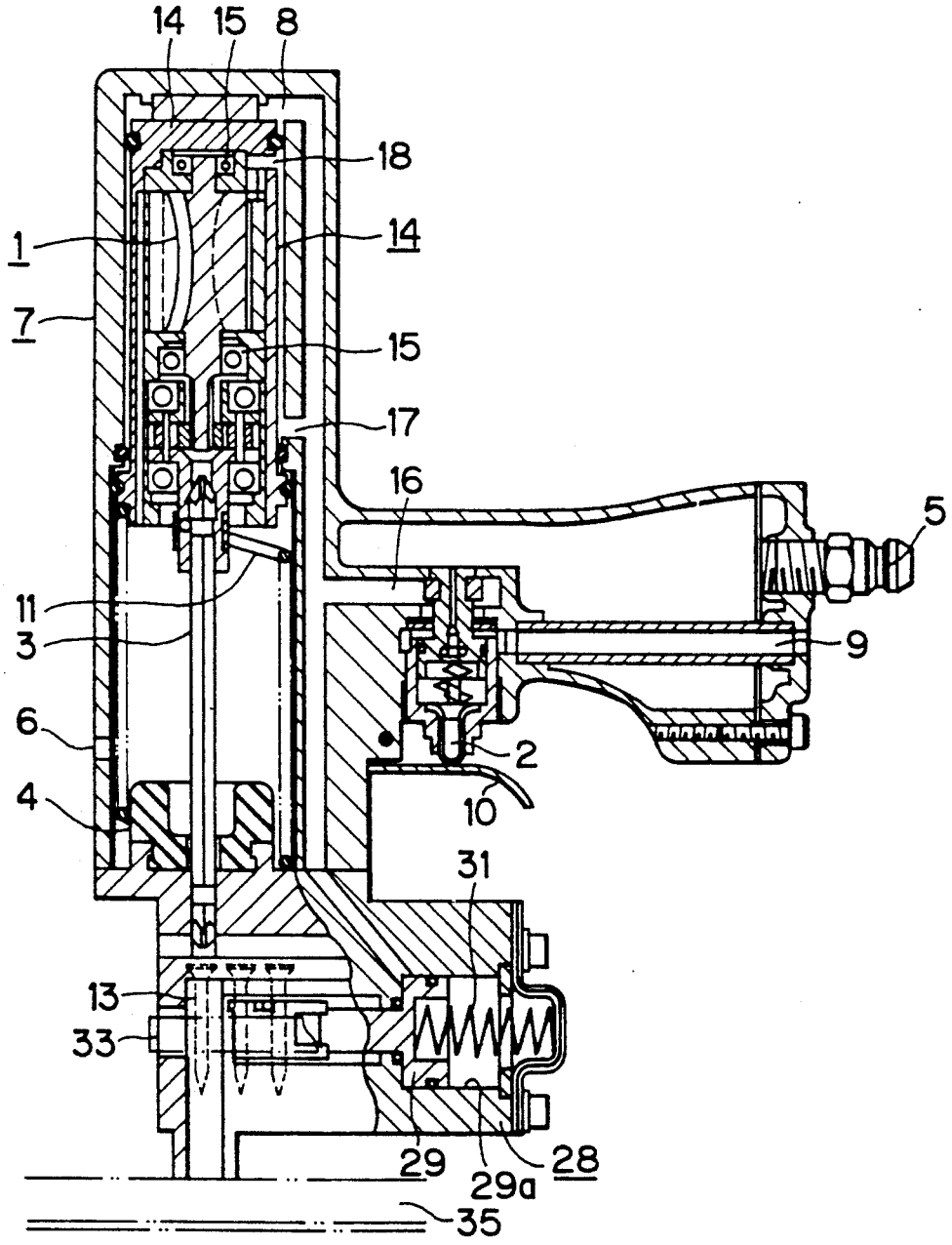
FIG. 1 Prior Art
FIG. 1 is a cross-sectional view showing a conventional pneumatically operated screw driver.

A pneumatically operated screw driver according to a first embodiment of this invention will be described with reference to FIGS. 2 and 3.

The driver generally includes a pneumatically rotatable rotor 101, a power transmission unit 103 for rotating a screw 13 about an axis thereof, a main valve 111, a shut off valve 110, a moving unit 114, and a screw supply unit 28. The frame 107 houses therein the rotor 101 in which an axially hollow space **101*a* is formed. The rotor 101 has upper and lower sleeve portions 101*b* and 101*c* rotatably journalled by bearings 115, 115 fixed to annular projecting portions 107*c*, 107*d* of the frame 107. Therefore, the rotor 101 is rotatably supported by the outer frame 107. The rotor 101 also has a blade portion 101*d* having a diameter larger than that of the sleeve portions 101*b*, 101*c*. At a position confronting the blade portion, an air discharge port 106 is formed at a side wall of the outer frame. The upper sleeve portion 101*b* defines therein an inlet passage 108. Further, a plurality of radial bores 101*e* are formed in the upper sleeve portion 101*b*. These bores 101*e* are in fluid communication with an air passage 107*a* formed in the frame 107. The air passage 107*a* is communicated with the blade portion 101***d* for applying compressed air thereto in order to rotate the blade portion 101*d*.

At a position between a top cover 107*f* and an upper portion of the rotor 101, the main valve 111 having a cylindrical shape is vertically movably disposed. The main valve 111 has a large diameter portion 111*a* slidable with respect to an annular recess 107*b* formed in the outer housing 107. The large diameter portion 111*a* has an upper pressure receiving surface 111*b*. Further, an internal stepped portion 111*c* is provided in the main valve 111, and a coil spring 140 is interposed between the internal stepped portion 111*c* and the top cover 107*f* for normally urging the main valve 111 toward an upper surface of the annular projecting portion 107*c*. An outlet port 109 is defined adjacent the top cover 107*f*. When the main valve 111 has the lowermost position (FIG. 2), an air within the main valve 111 can be discharged outside through the outlet port 109.

In the axial bore 101*a* of the rotor 101, the moving unit 114 is slidably disposed. The moving unit 114 is rotatable about its axis together with the rotation of the rotor 101 because of a spline connection at 114*b*. An upper portion of the moving unit 114 is provided with a large diameter portion or a piston 114*a* in slidable contact with the hollow space 101*a* of the rotor 101. An upper surface of the piston 114*a* serves as a pressure receiving surface. At a position below the piston 114*a*, an annular space S is defined between an inner peripheral surface of the rotor 101 and an outer peripheral surface of the moving unit 114. Further, a communication passage 112 is formed in the piston 14*a*. The communication passage 112 having one end communicated with the inlet passage 108 and another end communicated with the annular space S through a check valve (reed valve) 144. The moving unit 114 has a lower portion to which a drive bit 103 for rotating the screw 13 is integrally and coaxially fixed.

The rotor 101 is formed of a material having low specific gravity, for example, aluminum and synthetic resin, in order to provide a light weight rotor, whereby initial start up period can be minimized so as to provide a predetermined rotation number within a short time.

The moving unit 114 has an upper end portion to which a shut off valve 110 is integrally and coaxially provided.

At a lower portion of the screw driver, the screw supply unit 28 is provided. The screw supply unit 28 includes a supply piston 29, a coil spring 31, a feed pawl(not shown), and a linking band 33 in a conventional manner. The coil spring 31 is disposed within a piston chamber 29*a* for normally urging the supply piston 29 toward a position away from the drive bit 103. The feed pawl is movably supported at a tip end of the feed piston 29 and engageable with a hole formed in the linking band 33 for supplying the screw 13 to the position immediately below the drive bit 103 in order to successively feed each one of the screws 13 to a position coaxially with the drive bit 3 and therebelow against the biasing force of the coil spring 31.

A fluid circuit is provided in the outer frame 107 for moving the moving unit 114 and the piston 29 and for rotating the rotor 101. That is, a compressed air inlet port 105 is provided in the frame 107, and air accumulation space S1 is provided within the outer frame 107. The inlet port 105 is connected to a compressed air source (not shown). The inlet port 105 is communicatable with an operation valve 102 movable by a trigger 110 secured to the outer frame 107. A first passage way 141 is connected between the operation valve 102 and the annular recess 107*b* so as to apply pneumatic pressure to the upper pressure receiving surface 111*b* of the main valve 111 when the latter has the lowermost position. Compressed air in the air accumulation space S1 is applied to an outer peripheral surface of the main valve 111. Further, a second passage way 142 is, connected between the operation valve 102 and the piston 29 so as to the piston 29 toward the drive bit 103 against the biasing force of the coil spring 31.

Figure 2:
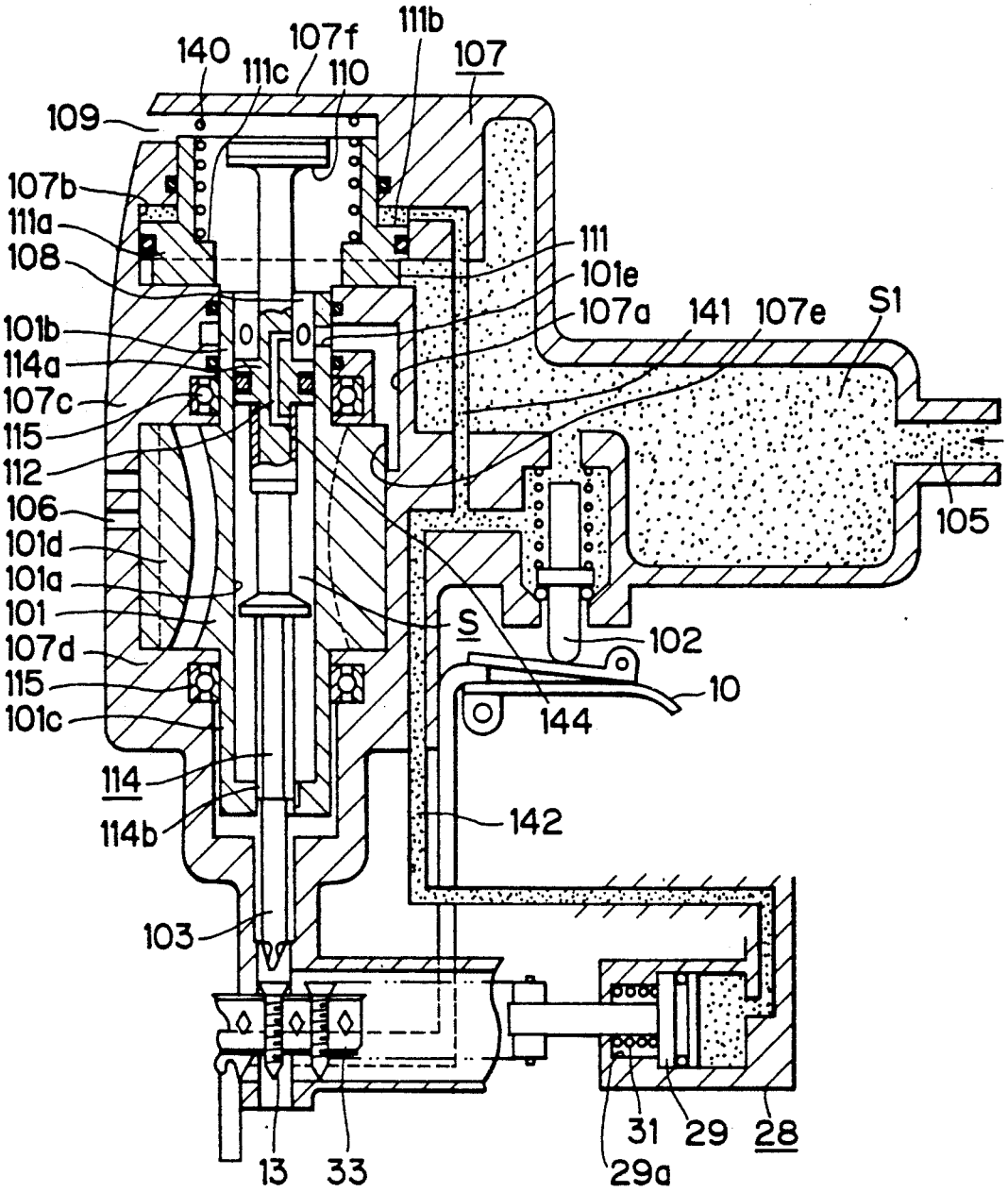
FIG. 2 is a cross-sectional view showing a pneumatically operated screw driver according to a first embodiment of the present invention, and showing a state prior to the screw driving operation.

In a state shown in FIG. 2, the compressed air supplied from the inlet port 105 is accumulated in the air accumulation space S1, and is applied to the upper pressure receiving surface 111*b* of the main valve 111 through the first passageway 141 and to the piston 29 through the second air passageway 142. Thus, the main valve 111 is depressed downwardly, and the piston 29 is urged leftwardly. In this state, the air within the main valve 111 can be discharged outside through the outlet port 109.

Figure 3:
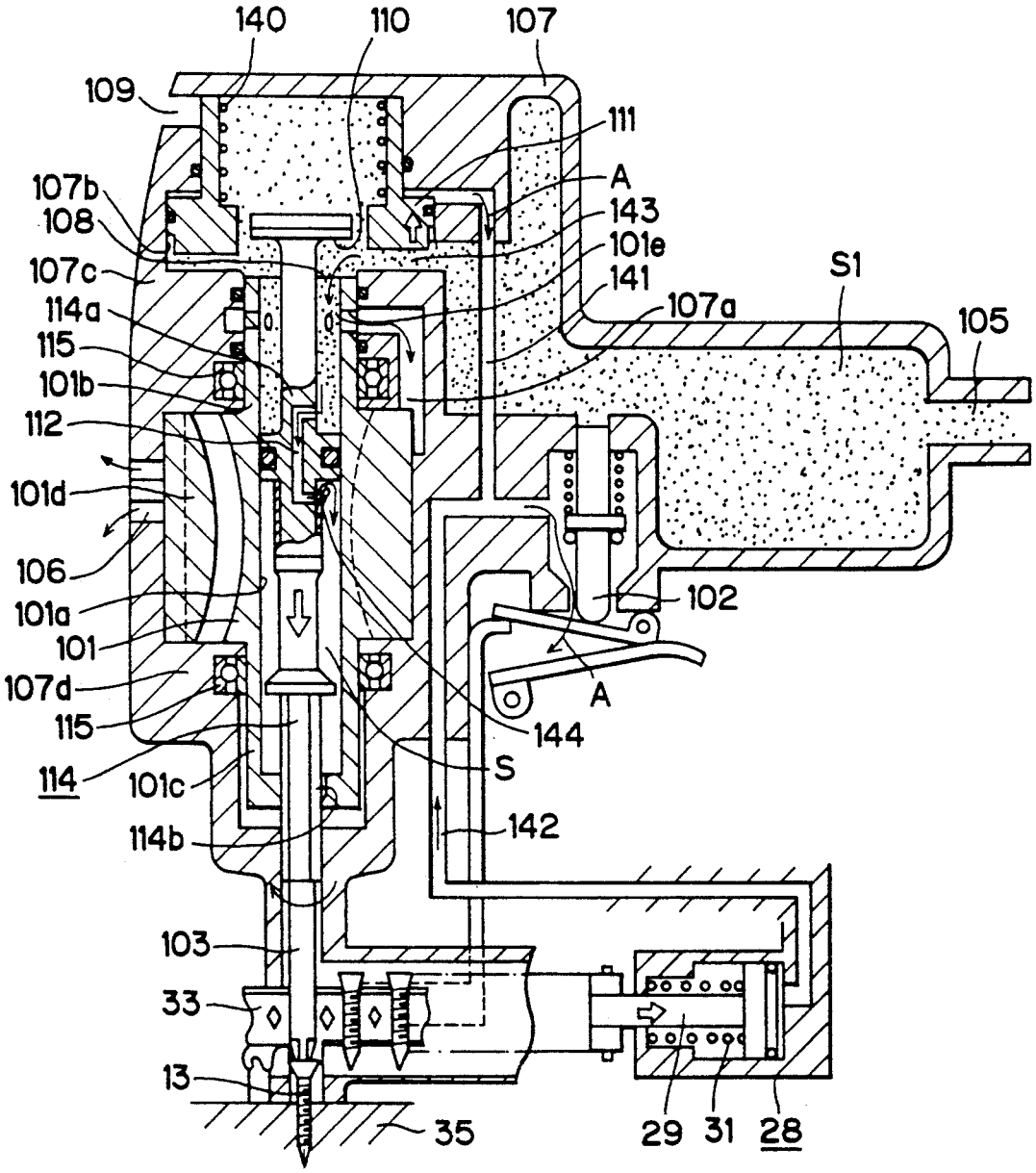
FIG. 3 is a cross-sectional view showing a pneumatically operated screw driver according to a first embodiment, and showing a screw driving operational state.

Then, if the trigger 10 is pulled up for operating the operation valve 102 as shown in FIG. 3, the compressed air applied to the upper pressure receiving surface 111*b* of the main valve 111 can be discharged outside through the first passageway 141 and through the operation valve 102 as indicated by an arrow A. In this case, the pneumatic pressure within the accumulation space S1 is applied to a lower surface of the main valve 111, and accordingly, the main valve 111 is moved upwardly because of the pressure differential established between the upper and the lower pressure receiving surfaces of the main valve 111. Thus, the lower surface of the main valve 111 is moved away from the bottom surface of the annular recess 107*b* to provide a new fluid passage 143. Since the fluid passage 143 is in communication with the inlet passage 108, the pneumatic pressure can be applied to the upper surface of the piston 114*a*, so that the latter begin to move downwardly. Accordingly, the drive bit 103 is linearly moved to a position immediately above the screw 13.

Further, the compressed air within the inlet passage 108 can be introduced into the blade portion 101*d* of the rotor 101 through the air passage 107*a*, and therefore, the rotor 101 is rotated. Thus, the drive bit 103 is also rotated because of the spline connection 114*b* with respect to the rotor 101 in order to provide a composite rotational and axial movement of the moving unit 114 and the drive bit 103. Incidentally, since the annular space S is communicated with the inlet passage 108 by way of the communication passage 112, the compressed air is also introduced into the annular space S.

If the moving unit 114 is moved downwardly by a predetermined stroke, the screw driving operation can be finished. At this time, the shut off valve 110 is brought into contact with the upper opening of the inlet passage 108, since the shut off valve 110 is provided integral with the moving unit 114. Accordingly, the compressed air cannot be any more introduced into the inlet passage 108. Thus, the rotation of the rotor 101 is stopped.

The compressed air in the inlet passage 108 can be accumulated within the annular space S through the communication passage 112 and the check valve or reed valve 144 (see deformed reed 144). Further, the compressed air in the piston chamber 29*a* is discharged outside through the second passageway 142 and the operation valve 102. Therefore, the feed piston 29 and the feed pawl are moved away from the drive bit 103, so that the feed pawl (not shown) of the screw supply unit 28 can be retracted away from the screw 13.

Next, when the trigger 10 is released as shown in FIG. 2, the compressed air is again applied to the upper pressure receiving surface 111b of the main valve 111, so that the main valve 111 is moved downwardly to thereby open the outlet port 109. Thus, the air stayed above the moving member 114 is discharged to the atmosphere through the outlet port 109. Upon discharge of the air, the moving member 114 is moved upwardly because of the compressed fluid confined within the annular space S by the reed 144, so that the moving member 114 can restore its original position. Further, the screw feed unit 28 can be supplied with the compressed air, so that the feed piston 29 and the feed pawl are moved toward the drive bit 103 for supplying subsequent screw 13 just below the drive bit 103.

According to the first embodiment described above, the moving member 114 has a small mass, since it is positioned within the hollow space of the rotor 101, and the rotor 101 is not vertically movable but only the moving member 114 is vertically moved. Therefore, repulsive and reactive force can be reduced to a low level, and a compact outer frame 107 results. As a result, enhanced operability to the screw driver and prolonged durability thereof can be provided. Further, the air inlet passage 108 can be closed by the shut off valve 110 approximately simultaneously with the completion timing of the screw fixing to the workpiece. Accordingly, unnecessary compressed air supply to the rotor 101 is avoidable, i.e., waste of the compressed air can be reduced. As a result, great numbers of screws can be subjected to driving operation.

Figure 4:
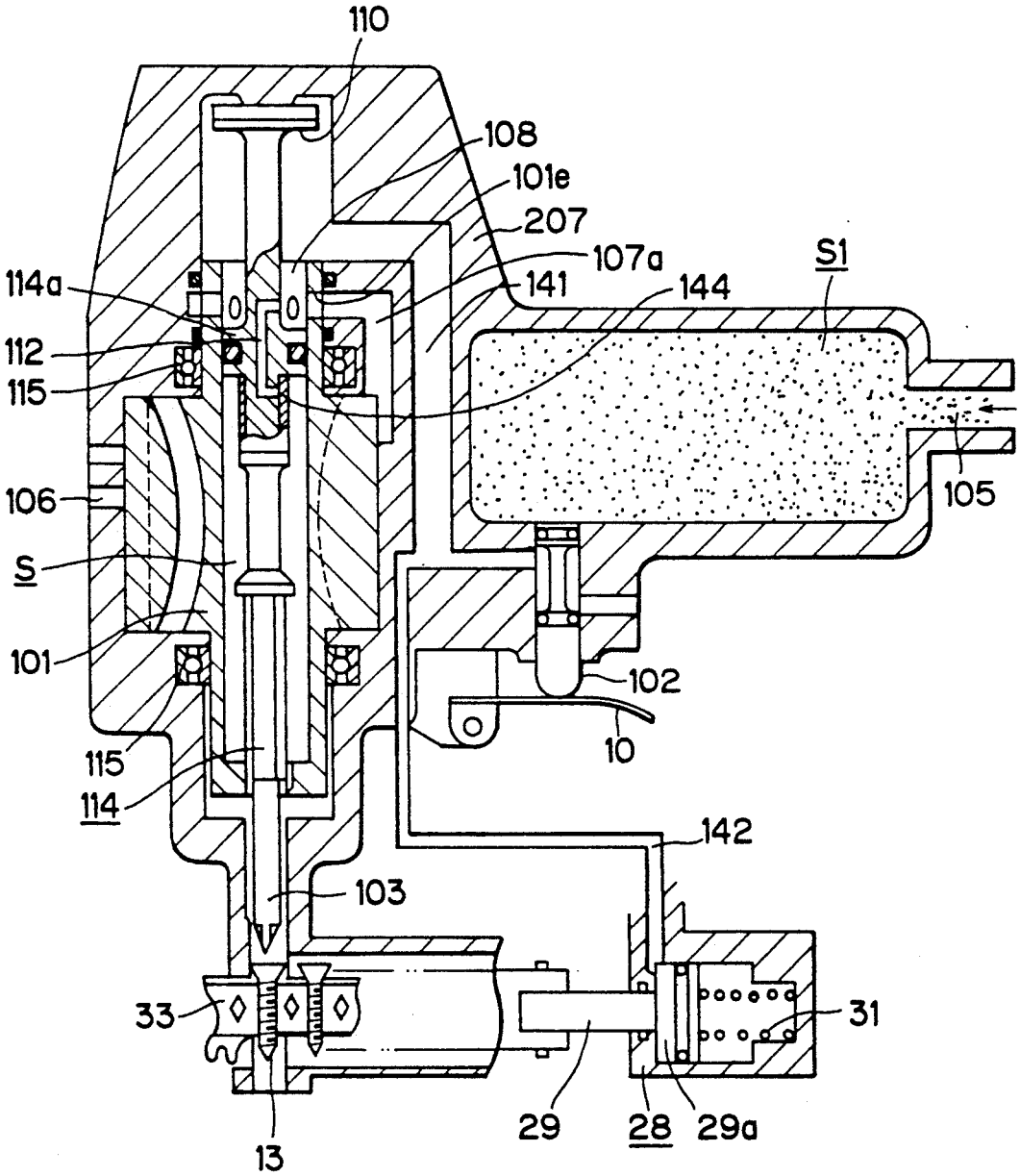
FIG. 4 is a cross-sectional view showing a pneumatically operated screw driver according to a second embodiment of this invention.

A pneumatically operated screw driver according to a second embodiment of this invention will next be described with reference to FIG. 4 wherein like parts and components are designated by the same reference numerals as those shown in the first embodiment. In the second embodiment, the main valve 111 of the first embodiment is dispensed with. Instead, the second embodiment has an arrangement such that when the trigger 10 is pulled up for moving the operation valve 102, the compressed air is directly introduced into the inlet passage 108 and into the piston chamber 29*a*. Further, in the second embodiment, the feed piston 29 is normally urged by the coil spring 31 toward the drive bit 103, opposite the first embodiment. Therefore, in the second embodiment, a new screw 13 can be supplied immediately below the drive bit 103 when the compressed air within the piston chamber 29*a* is discharged outside through the second passageway 142 and through the operation valve 102.

Other essential arrangement is the same as that of the first embodiment, particularly with respect to the arrangement of the rotor 101, the moving unit 114 and the shut off valve 110. Therefore, the second embodiment provide advantages substantially the same as that of the first embodiment.

Figure 5:
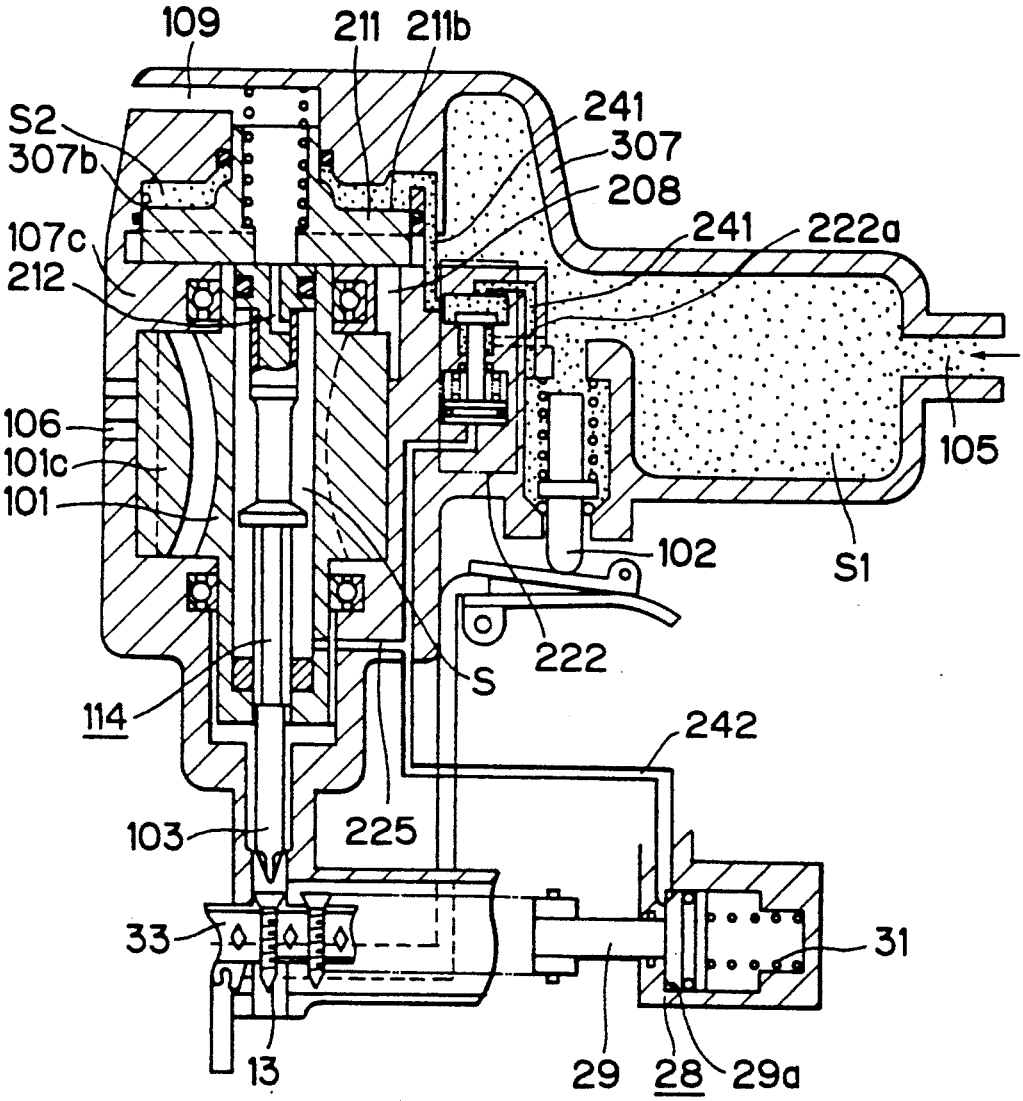
FIG. 5 is a cross-sectional view showing a pneumatically operated screw driver according to a third embodiment.

A pneumatically operated screw driver according to a third embodiment of this invention will next be described with reference to FIG. 5 wherein like parts and components are designated by the same reference numerals as those shown in the foregoing embodiments. In the third embodiment, the shut off valve 110 used in the first and the second embodiments is dispensed with. Instead, an inlet passage 208 corresponding to a combination of the inlet passage 108 and the air passage 107*a* of the foregoing embodiments is formed at the annular projection 107*c*. That is, the inlet passage 208 has one end directly opened to an upper surface of the annular projection 107*c*, and has another end communicated with the blade portion 101*c*.

Most importantly, a change-over valve 222 is further provided within the outer frame 307. The change-over valve 222 is communicatable with the annular space S through a passage 225, and with the piston chamber 29*a* through a passage 242. The change-over valve 222 is also communicatable with an annular space S2 defined between the annular recess 307*b* and the main valve 211. Further, the change-over valve 222 is communicatable with the air chamber S1 through a passage 222*a* as shown by broken line in FIG. 5 so as to apply pneumatic pressure to the upper surface 211*b* of the main valve 211 through the passage 241.

When the screw 13 is almost screwed into the workpiece, the compressed air confined in the annular space S urges a valve body of the change-over valve 222 upwardly through the passage 225. Thus, the change-over valve 222 provides fluid communication between the air chamber S1 and the passage 241 through the passage 222*a* for applying pneumatic pressure into the upper surface 211*b* of the main valve 211. Thus, the main valve 211 is completely seated onto the upper surface of the annular projection 107*c* in order to close an open end of the inlet passage 208. Accordingly, unnecessary compressed air supply into the rotor 101 is avoidable for reducing waste of the air.

Incidentally, the feed piston 29 is normally urged in a direction to feed the screw 13 by the biasing force of the coil spring 31. However, if the inner pressure within the annular space S becomes sufficiently high, the compressed air urges the piston 29 in opposite direction against the biasing force of the coil spring 31 through the passages 225 and 242.

A pneumatically operated screw driver according to a fourth embodiment of this invention will next be described with reference to FIGS. 6 through 8. The fourth embodiment is similar to the third embodiment in that the shut off valve 110 in the first embodiment is dispensed with, and configuration of the main valve 211 and the inlet passage 208 is the same as those of the third embodiment. However, in the fourth embodiment, a time setting valve means 315 is provided instead of the change-over valve 222.

More specifically, the time setting valve means 315 is adapted for supplying compressed air to the upper surface of the main valve 211 after elapse of predetermined period for lowering the main valve 211. Incidentally the screw feed unit 28 is the same as that of the first embodiment.

The time setting valve means 315 includes a valve block in which a first valve piston chamber 326 and a second valve piston chamber 327 are defined. The first valve piston chamber 326 is connected to the operation valve 102 through a check valve 317 and a branch passage 316 whose end connected to the first valve piston chamber 326 has a small diameter to provide a throttle opening 316*a*. The second valve piston chamber 327 is positioned above the first valve piston chamber 326, and is communicatable with the air chamber S1 through a bore 328. The second valve piston chamber 327 is also communicatable with an upper space of the main valve 211 through a passageway 341, and with the operation valve 102 through a passage 329. That is, the second valve piston chamber 327 has a stepped portion 327*a* to provide a seat portion for a second piston 318*b*. A valve piston 318 is movably provided in these valve chambers 326 and 327. That is, the valve piston 318 has a first piston 318*a* slidably disposed in the first valve piston chamber 326, the second piston 318*b* movably disposed in the second valve piston chamber 327 and adapted to close the bore 328, and a piston rod 318*c* interconnecting the first and the embodiment, a damper member 481 formed of a rubber is provided at a bottom of the lower sleeve portion 101*c*. The moving unit 114 is provided with a flange 114*c* abuttable on the damper member 481.

Figure 6:
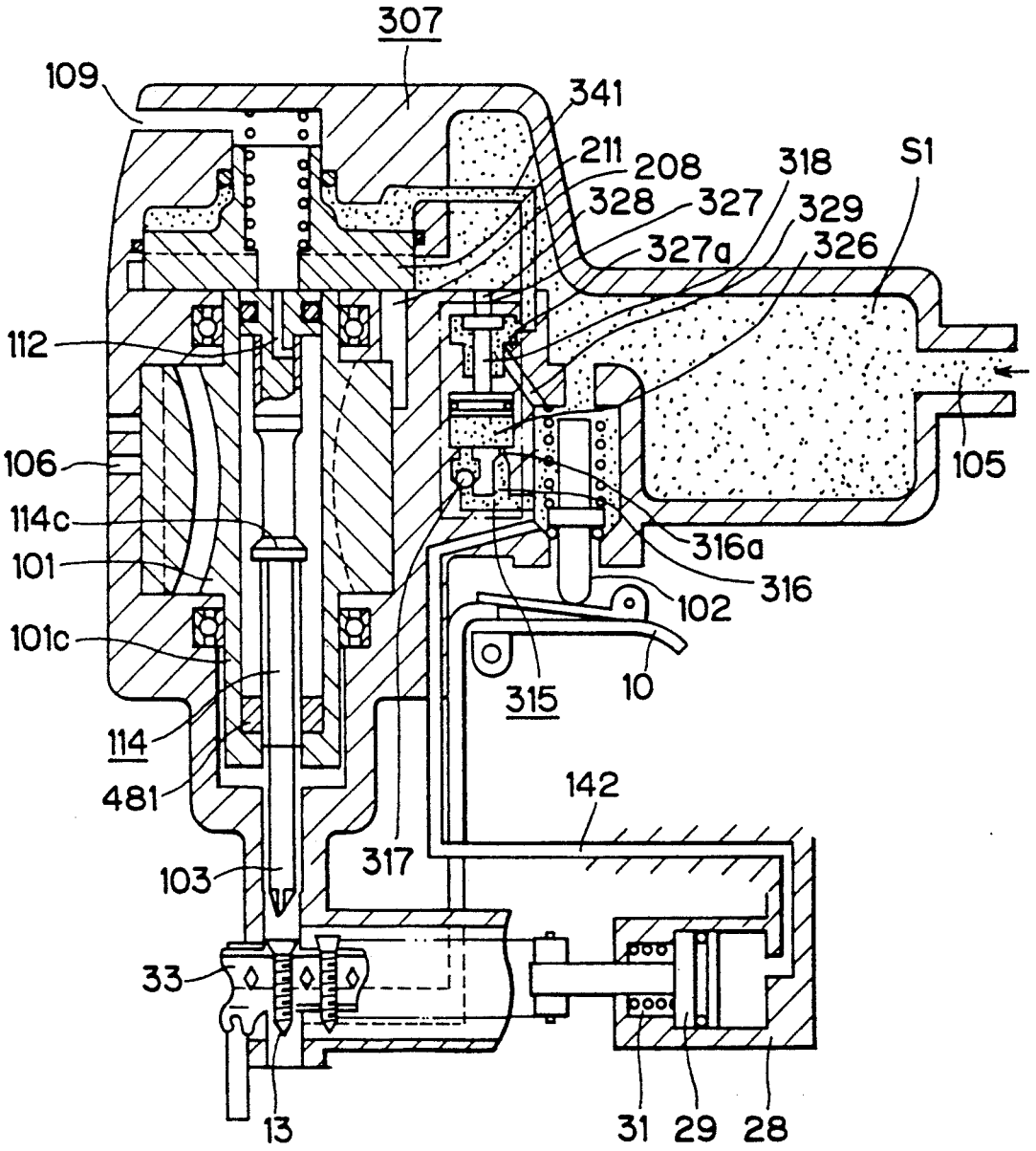
FIG. 6 is a cross-sectional view showing a pneumatically operated screw driver according to a fourth embodiment of this invention and showing a stand-by state thereof.

FIG. 6 shows a stand-by state of the screw driver. The valve piston 318 has an uppermost position so as to shut off air communication between the air chamber S1 and the second valve piston chamber 327. Further, the main valve 211 has the lowermost position to shut off the inlet passage 208, since the compressed air is applied to the upper surface portion of the main valve 211 by way of the operation valve 102, the passage 329, the second valve piston chamber 327 and the passageway 341.

Figure 7:
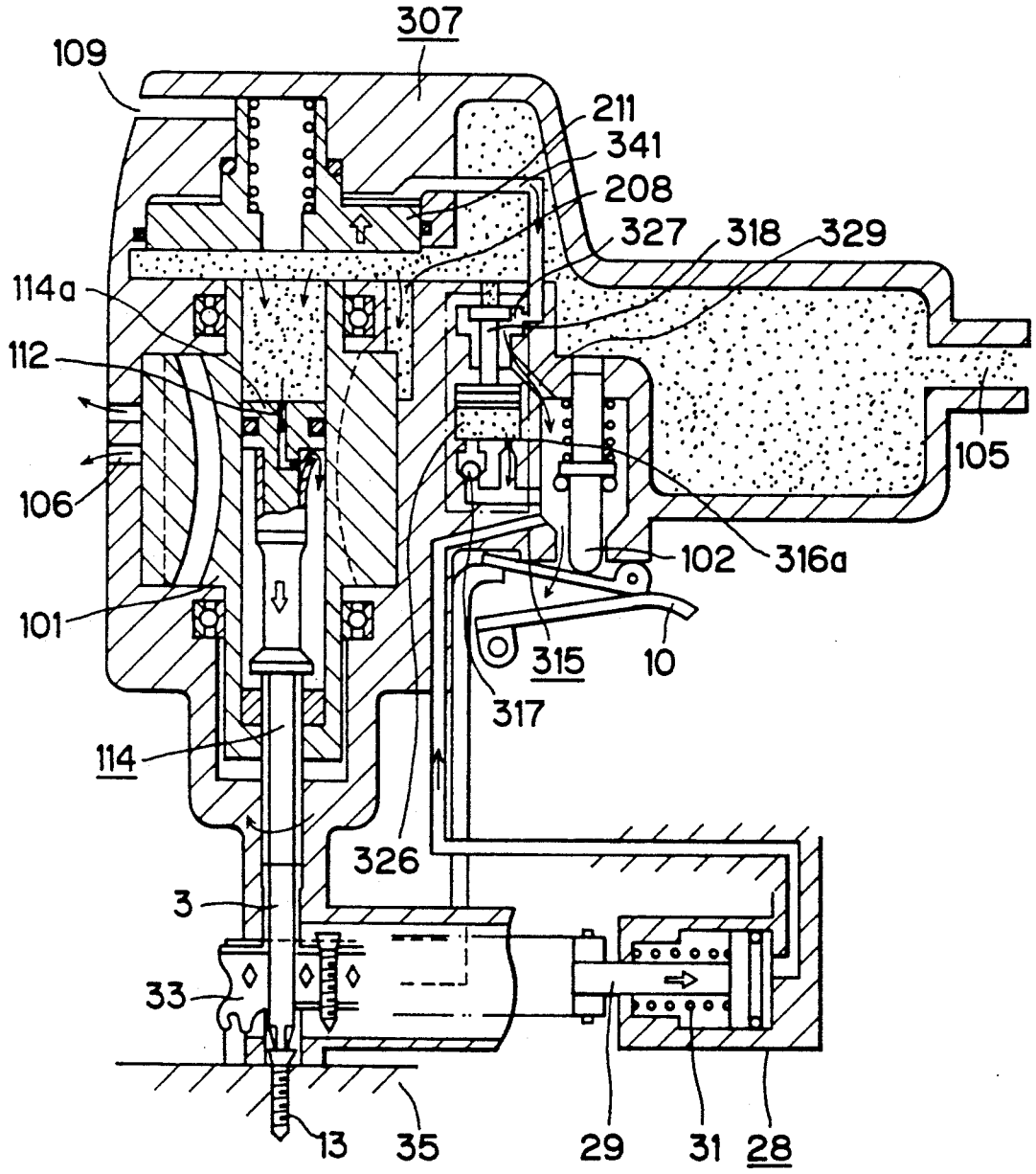
FIG. 7 is a cross-sectional view showing a pneumatically operated screw driver according to the fourth embodiment, and showing screw driving phase thereof.

FIG. 7 shows a screw driving phase by manipulation to the trigger 10 for moving the operation valve 102. The compressed air applied to the upper surface of the main valve 211 is discharged out of the operation valve 102 to the atmosphere through the passageway 341, the second valve piston chamber 327 and the passage 329. Therefore, the main valve 211 can be moved upwardly because of the pneumatic pressure in the air chamber S1 for opening the inlet passage 208. Further, the pneumatic pressure can also be applied to the upper surface of the piston 114*a* of the moving unit 114 in order to lower the same in the axial direction thereof while being rotated about its axis. Therefore, the screw 13 can be rotatingly driven downwardly. In this case, compressed air within the first valve piston chamber 326 is gradually discharged from the operation valve 102 through the throttle opening 316*a* and the passage 316. Accordingly pneumatic pressure level within the chamber 326 is gradually lowered.

Figure 8:
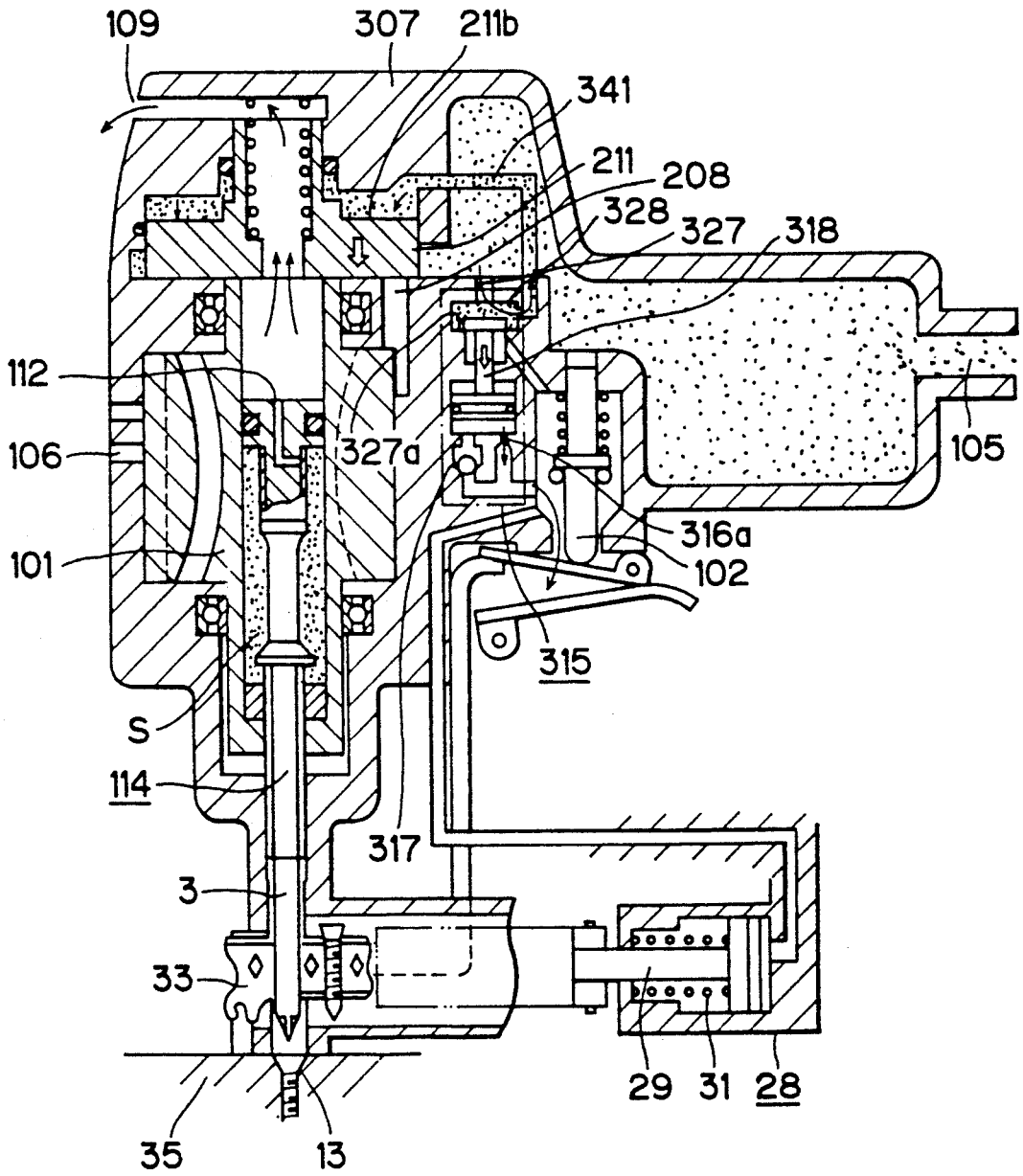
FIG. 8 is a cross-sectional view showing a pneumatically operated screw driver according to the fourth embodiment, and showing completion state of the screw driving operation.

FIG. 8 shows a state of completion of the screw driving operation in which the screw 13 is completely screwed into the workpiece 35. The pneumatic pressure within the first valve piston chamber 326 becomes lower than that applied to the upper surface of the second piston 318*b*. Therefore, the valve piston 318 is moved downwardly. By this movement, the air communication between the second valve piston chamber 327 and the operation valve 102 is shut off, since the second piston 318*b* is seated on a stepped portion 327*a* of the second valve piston chamber 327. At the same time, the compressed air within the air chamber S1 can be introduced into the second valve piston chamber 327 through the bore 328, and is applied to the upper surface of the main valve 211 through the passageway 341. Accordingly, the main valve 211 can be moved downwardly for closing the inlet passage 208. Thus, further consumption of the compressed air after completion of the screw driving operation can be avoided.

It should be noted that a cross-sectional area of the throttle opening 316*a* is provided such that the valve piston 318 can be moved downwardly simultaneous with the completion timing of the screw driving operation. In other words, the cross-sectional area is so designed such that the compressed air within the first valve piston chamber 326 can be discharged therefrom to provide pressure difference between the upper portion of the second valve piston 318*b* and the lower portion of the first valve piston 318*a*, when the time period from the start to end of screw driving operation is elapsed.

Figure 9:
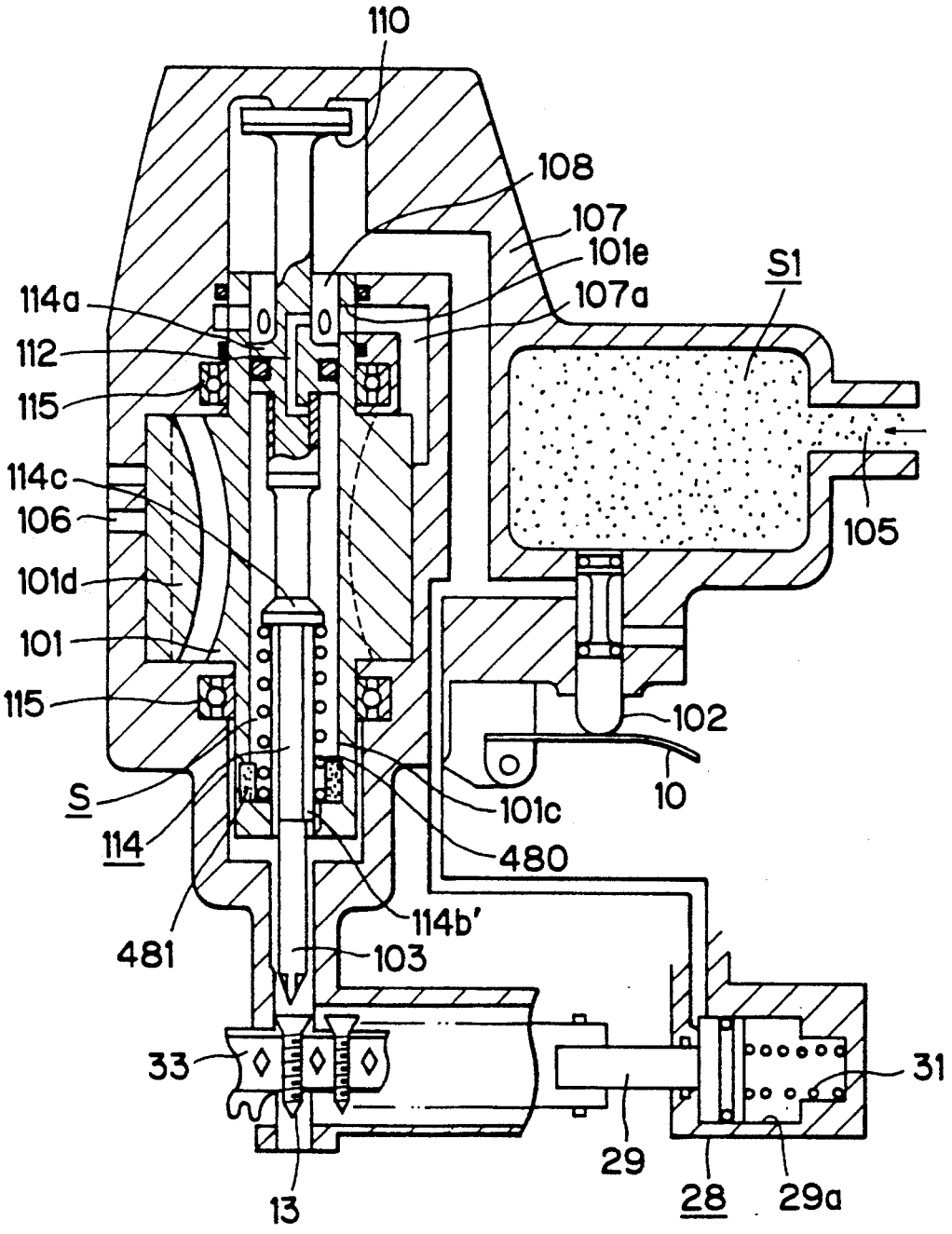
FIG. 9 is a cross-sectional view showing a pneumatically operated screw driver according to a fifth embodiment of this invention.

A pneumatically operated screw driver according to a fifth embodiment of this invention will next be described with reference to FIG. 9. In the first to third embodiments, the moving unit 114 is returned to the original position by making use of the pneumatic pressure within the annular space S after completion of the screw driving operation. On the other hand, according to the fifth embodiment, returning means is provided within the space S for positively returning the moving unit 114 to its original position. The illustrated embodiment shown in FIG. 9 is on the basis of the second embodiment shown in FIG. 4. However, it goes without saying that the concept of the fifth embodiment can be applied to the other embodiments.

In FIG. 9, a return spring 480 is interposed between the bottom wall of the lower sleeve portion 101*c* of the rotor 101 and the intermediate flange 114*c* of the moving unit 114 for normally biasing the moving unit 114 upwardly. Further, an annular damper member 481 is mounted on the bottom wall of the lower sleeve portion 101*c*. By suitably selecting the biasing force of the return spring 480, the moving unit 114 can be surely returned to the original position, and the moving unit can be moved downwardly because of the pneumatic pressure applied to the piston 114*a* with overcoming the biasing force of the return spring 480. Incidentally, in the fifth embodiment, a rod portion 114*b'* of the moving unit 114 has a hexagonal cross-section, and the bottom wall of the lower sleeve portion 101*c* of the rotor 101 is also formed with a corresponding hexagonal hole so as to transmit rotation of the rotor 101 to the moving unit 114.

In this connection regarding to the foregoing embodiments, the connection between the rotor 101 and the moving unit 114 is not limited to the spline and the hexagonal mating, but other structure is available so far as the rotation of the rotor 101 is transmittable to the moving unit and the moving unit 114 is axially slidable relative to the rotor 101. For example, a conventional ball-spline connection and roller connection may be available. In the latter case, the shaft portion of the moving unit 114 has a rectangular cross-section. A pair of rollers rotatably supported by the rotor 101 are disposed to interpose the shaft portion of the moving unit 114 therebetween. The shaft portion is vertically movable in sliding contact with the pair of rollers which are rotated about their axes during vertical movement of the shaft portion. The shaft portion is also rotatable about an axis thereof together with the circular movement of the rollers by the rotation of the rotor.

Further, in the foregoing embodiments, power transmission canceling means may be provided at a position between the moving unit 114 and the drive bit 103 so as to disconnect the rotor 101 from the drive bit 103 if the torque exceeds a predetermined level. A slip clutch may be available as the canceling means.

A pneumatically operated screw driver according to a sixth embodiment of this invention will next be described with reference to FIGS. 10 and 11 wherein like parts and components are designated by the same reference numerals as those shown in the forgoing embodiments.

Figure 10:
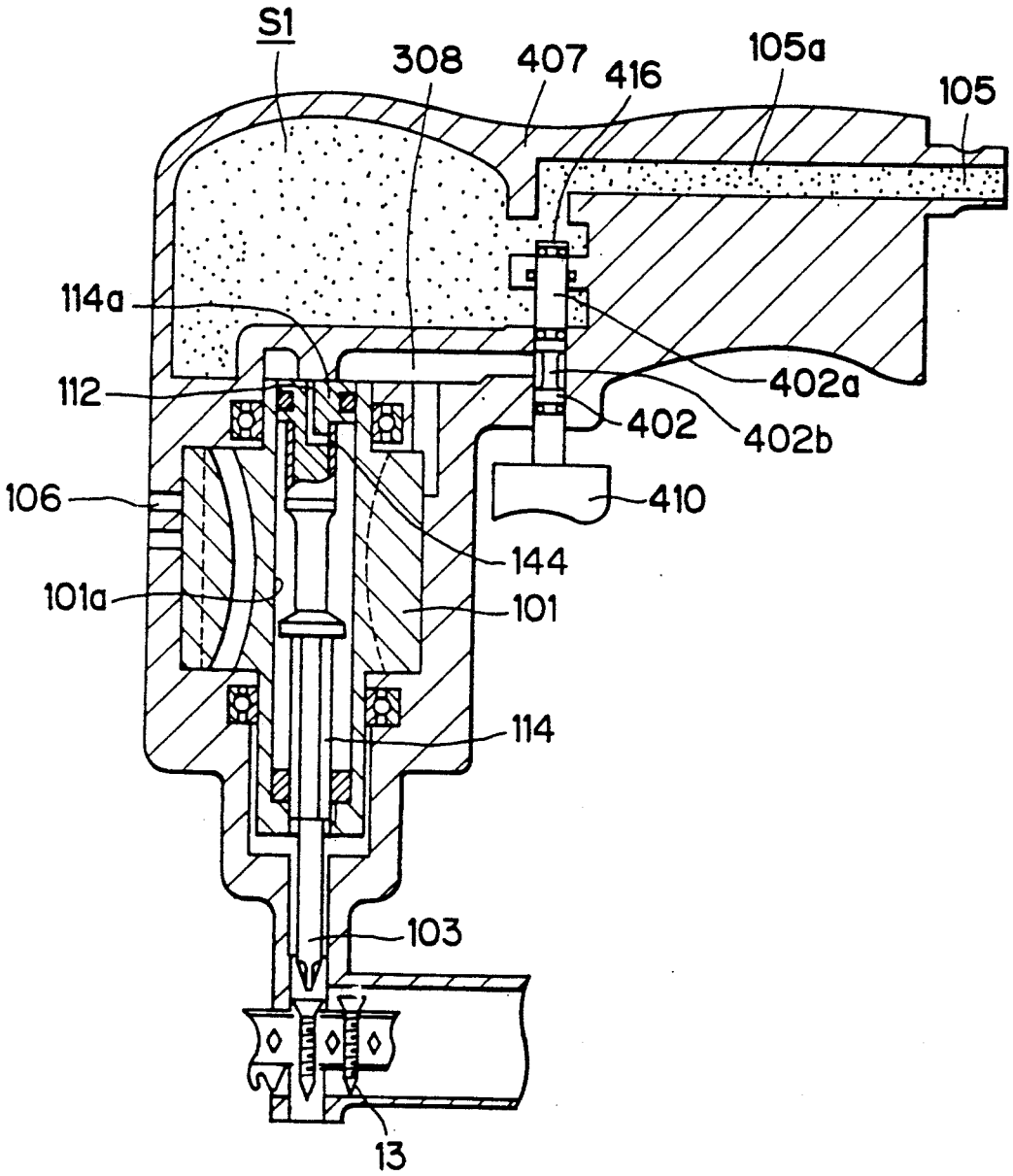
FIG. 10 is a cross-sectional view showing a pneumatically operated screw driver having a standby state according to a sixth embodiment of this invention.
Figure 11:
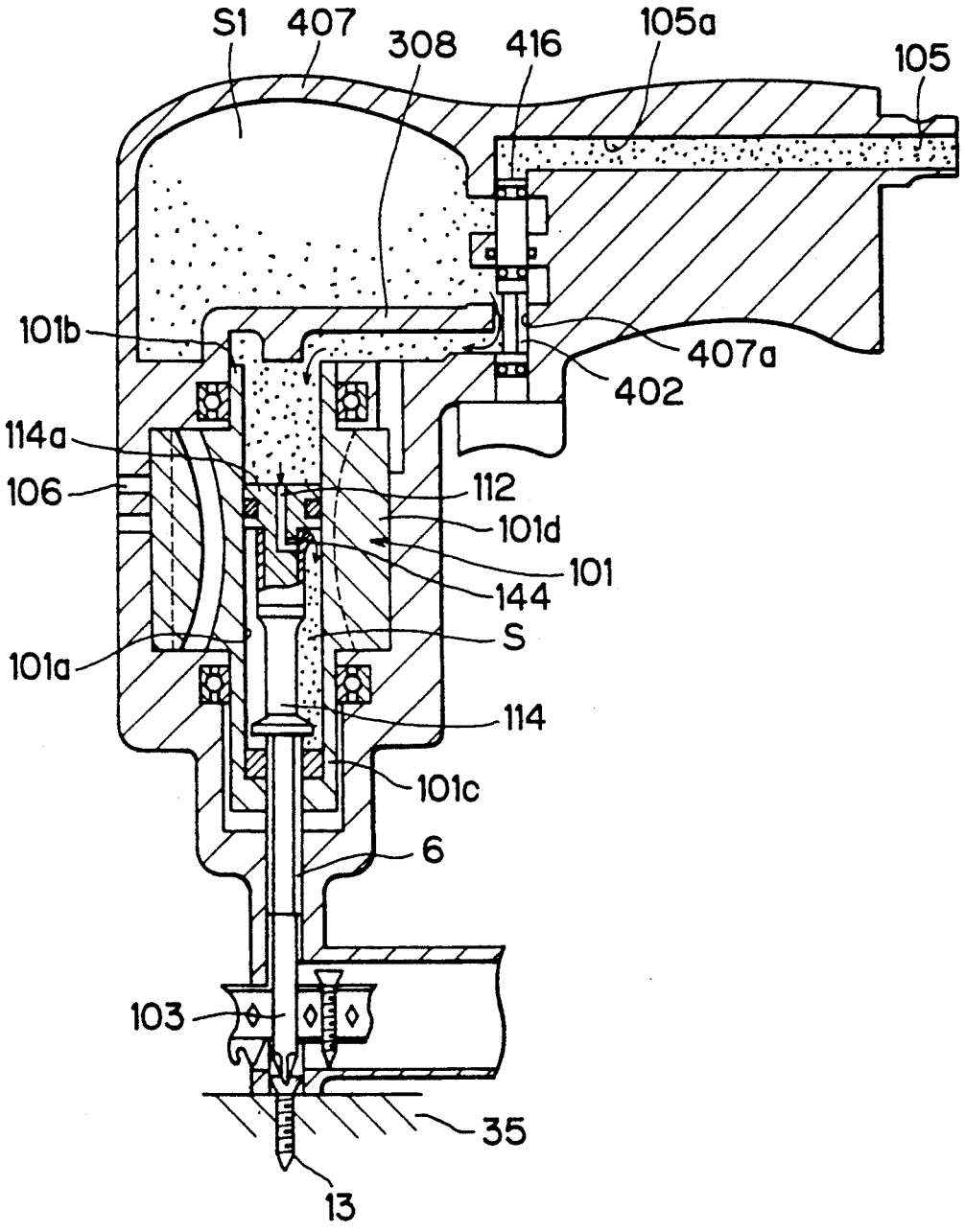
FIG. 11 is a cross-sectional view showing the pneumatically operated screw driver having a screw driving state according to the sixth embodiment.

In FIG. 10, an air chamber S1 communicating with the intake port 105 through an intake passage 105*a* is provided at a position above the rotor 101 and the moving unit 114. Further, an operation valve 402 is connected to a knob 410. The operation valve 402 has a large diameter shaft portion 402*a* and a small diameter shaft portion 402*b*. The large diameter shaft portion 402*a* is in mating sliding contact with a bore 407*a* so as to close the inlet passage 308 communicating with the blade portion 101*d* of the rotor 101 when the operation valve 402 has its lower position. Further, a tip end of the large diameter shaft portion is provided with a shut off valve 416 which is adapted to close an outlet end of the intake passage 105*a* for blocking air communication between the air chamber S1 and the intake passage 105*a* when the operation valve 402 has its upper position. Further, the small diameter shaft portion 402*b* permit the air in the air chamber S1 to be flowed into the inlet passage 308 through the bore 407*a* when the operation valve 402 has the upper position.

With this arrangement, in the state shown in FIG. 10, the operation valve 402 has the lower position, so that the compressed air from the intake passage 105*a* is introduced and accumulated in the air chamber S1. Then, as shown in FIG. 11, if the knob 410 is pushed upwardly, the operation valve 402 is axially moved upwardly, and the shut off valve 416 closes the outlet opening of the intake passage 105*a*, and at the same time the compressed air in the air chamber S1 can be introduced into the inlet passage 308 through the bore 407*a*. Therefore, the compressed air can be applied to the piston 114*a* of the moving unit 114 and to the blade portion 101*d* of the rotor 101. Thus, the moving unit 114 is axially moved downwardly with rotation about an axis thereof. In this case, the compressed air is also introduced into the annular space S through the communication passage 112 and the reed valve 144.

By the time where the screw driving operation is almost finished, the compressed air supply from the air chamber S1 may be terminated (the compressed air is almost used up). However, since the compressed air still exists in the hollow space S, the piston 114*a* is moved upwardly by the pneumatic pressure in the hollow space S. Thus, the moving unit 114 restores its original position.

In the sixth embodiment similar to the foregoing embodiment, the moving unit 114 is positioned within the rotor 101, and the moving unit 114 performs composite vertical and rotational movement, while the rotor only performs rotational movement. Therefore, compact size of the screw driver results. Further, waste of the compressed air is avoidable by the provision of the air chamber S1 and the operation valve 402. That is, the air chamber S1 only accumulates compressed air whose amount is only sufficient for completing the screw driving operation. In this connection, an internal volume of the air chamber S1 is experimentally determined.

Figure 12:
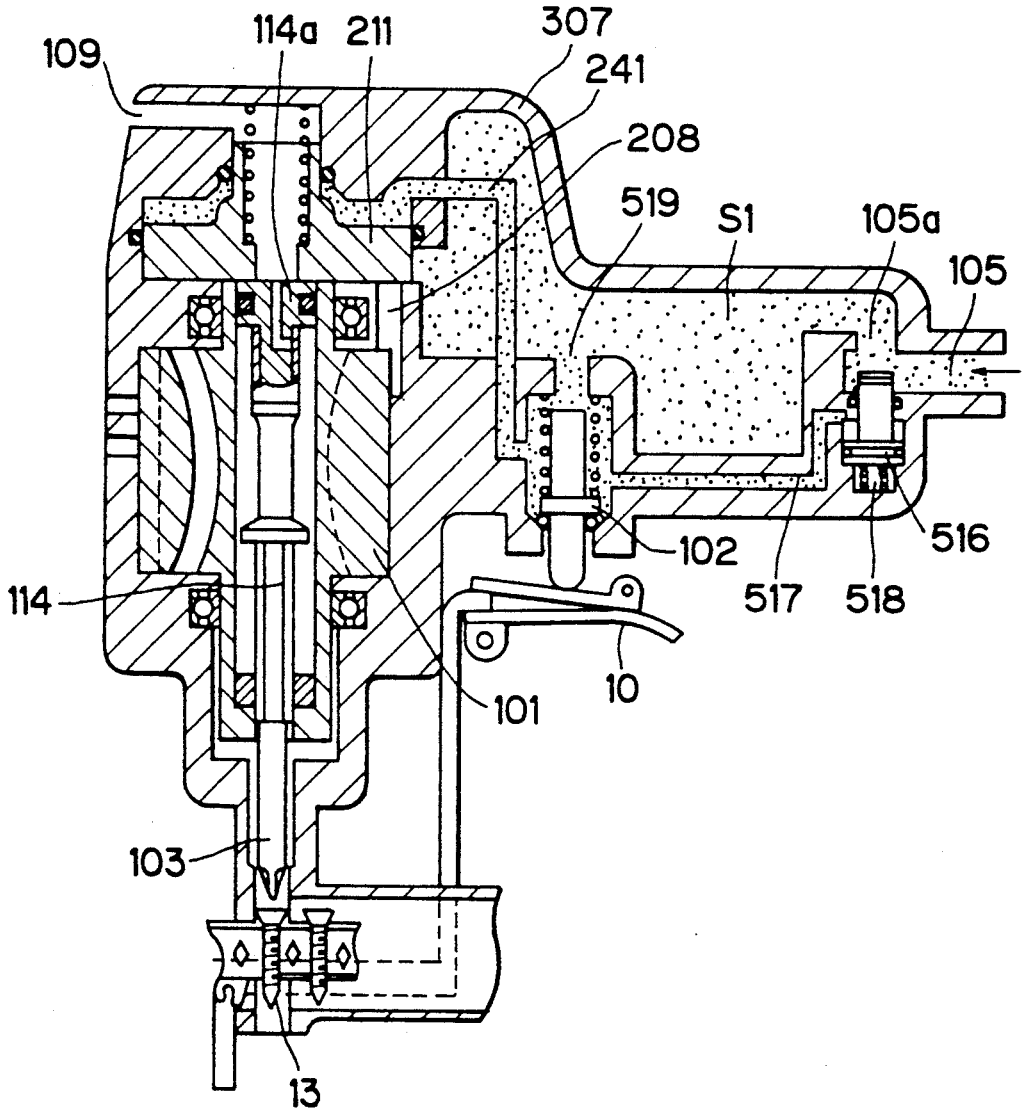
FIG. 12 is a cross-sectional view showing a pneumatically operated screw driver according to a seventh embodiment of this invention.

FIG. 12 shows a pneumatically operated screw driver according to a seventh embodiment of this invention. In the sixth embodiment, the operation valve 402 and the shut off valve 416 are provided integrally with each other. On the other hand, in the seventh embodiment, an operation valve 102 is provided separately from a shut off valve 516, and these valves 102 and 516 are communicatable with each other by a passage 517. The shut off valve 516 is disposed in the vicinity of the inlet port 105, and similar to the third and fourth embodiments, a main valve 211 is provided which is movable by the operation valve 102 upon manipulation to the trigger 10.

With the structure, the compressed air is accumulated within the air chamber S1. In this case, the operation valve 102 has its lower position because of the application of the pneumatic pressure within the air chamber S1. Therefore, the pneumatic pressure can be directed to the upper portion of the main valve 211 through the passageway 241. Thus, the main valve 211 has a lowermost position for closing the inlet passage 208. Further, the shut off valve 516 has its lower position to maintain open state of the inlet port 105 because of the application of pneumatic pressure to the shut off valve 516 by way of the passage 517.

If the trigger 10 is pulled up, the operation valve 102 is moved upwardly to close a bore 519. At the same time, compressed air applied to the upper surface of the main valve 211 can be discharged to the atmosphere out of the operation valve 102 through the passageway 241. Therefore, the main valve 211 is moved upwardly to open the inlet passage 208, so that the rotor 101 can be rotated and the moving unit 114 can be moved downwardly with its rotation. Simultaneously, the compressed air applied to the shut off valve can also be discharged through the operation valve 102, and therefore, the shut off valve 516 can be moved upwardly because of the biasing force of a coil spring 518 so as to close the inlet port 105. Thus, the compressed air is confined in the air chamber S1, and can be introduced only to the inlet passage 208 and to a portion above the piston 114*a*. When the compressed air in the air chamber S1 is almost used up, the moving unit 114 has its lowermost position whereupon the screw driving operation can be completed. Further, in this embodiment, the period of screw driving operation is controllable by the manipulation to the trigger 10.

Figure 13:
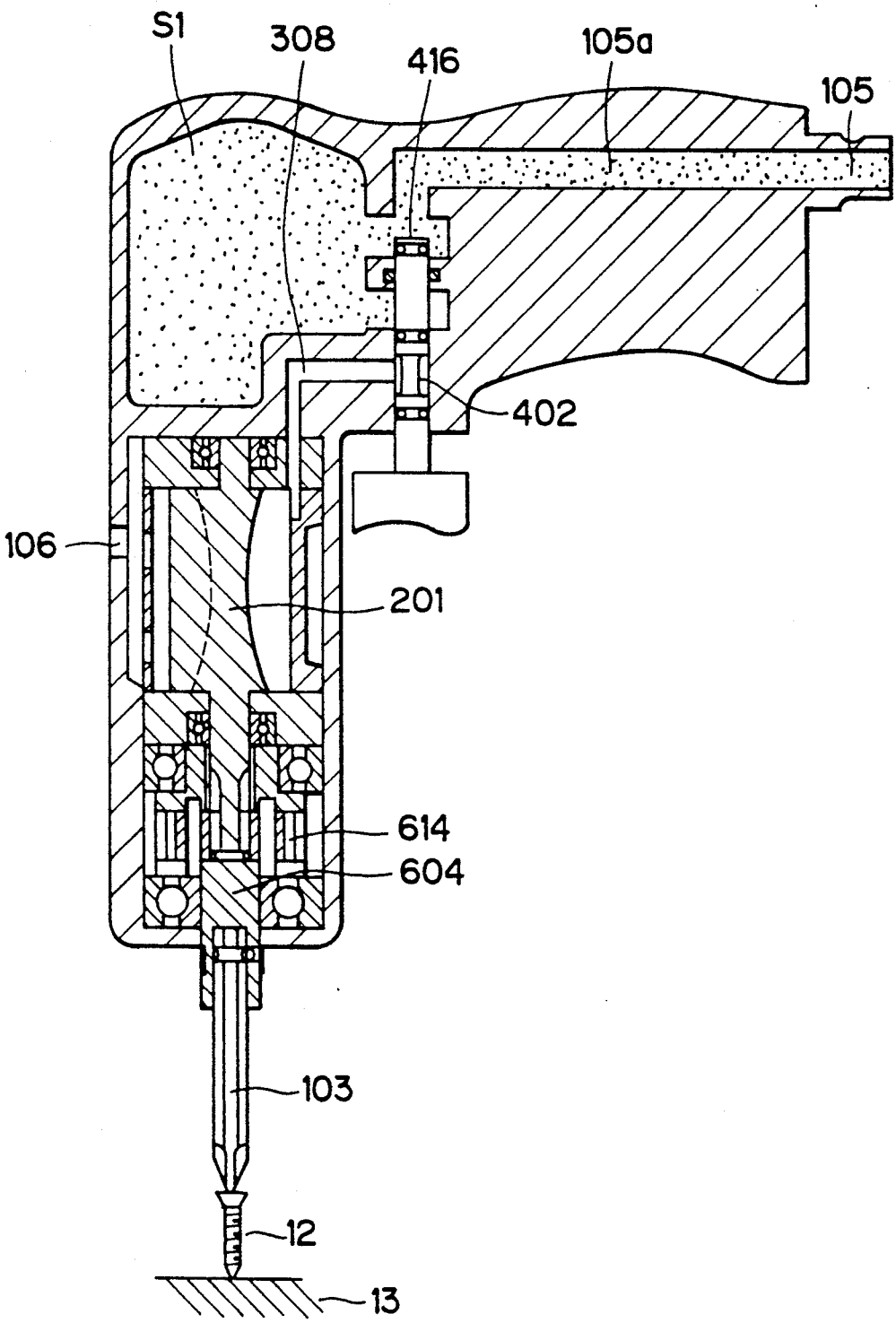
FIG. 13 is a cross-sectional view showing a pneumatically operated screw driver according to an eighth embodiment of this invention.
Figure 14:
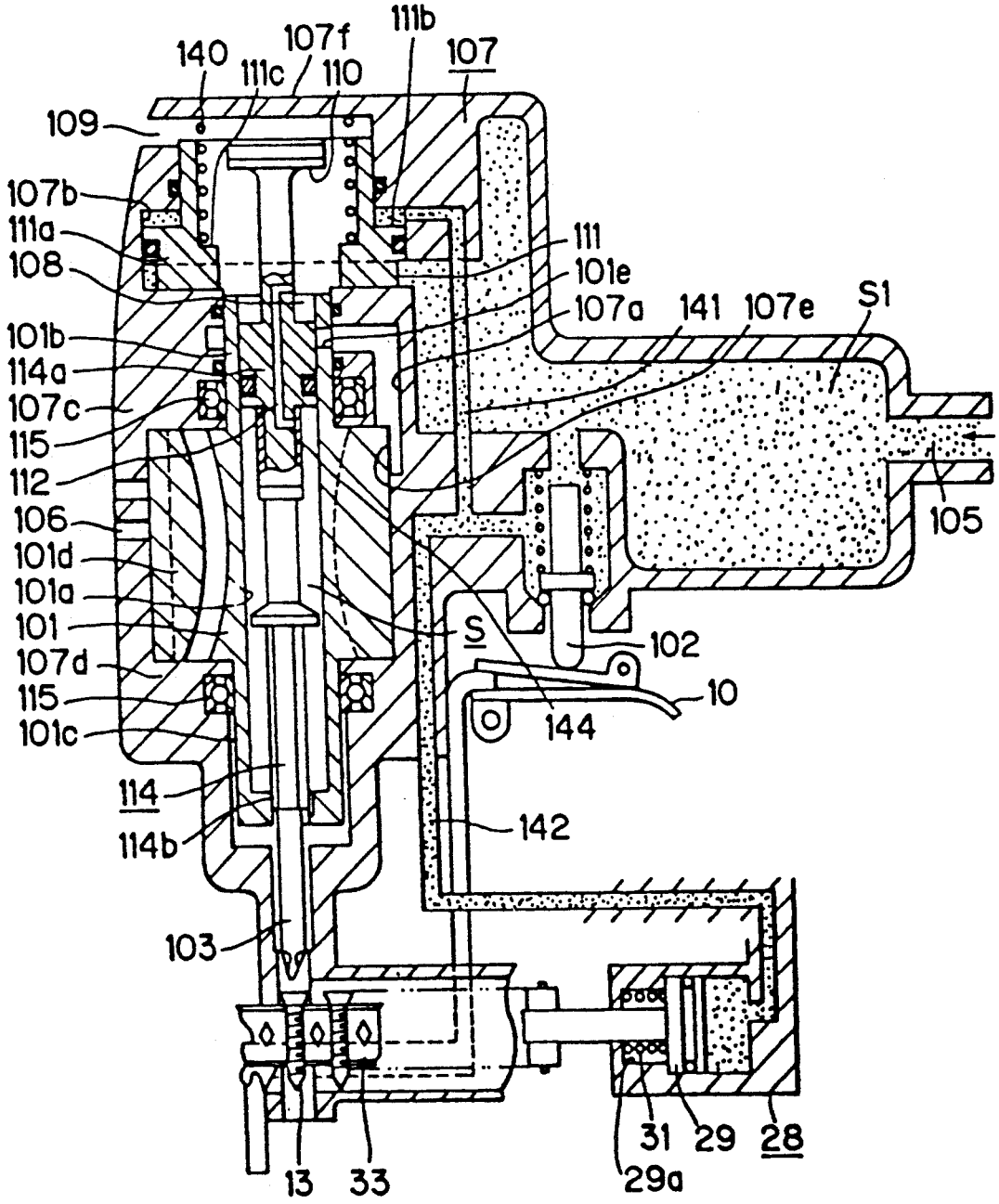
FIG. 14 is a modification of the FIG. 2 device showing an enlarged piston.
Figure 15:
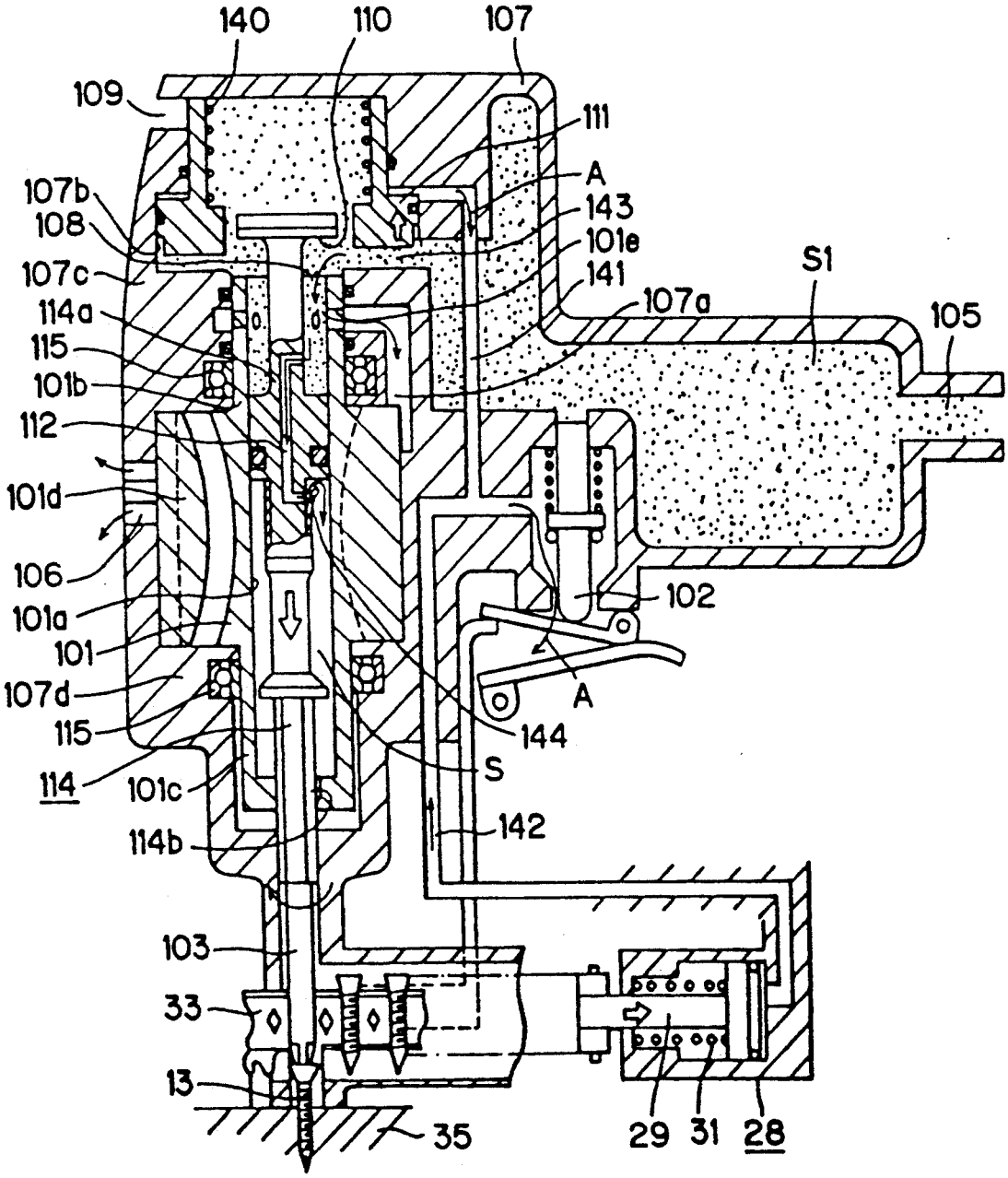
FIG. 15 is the modification of FIG. 14 with the driver in the lowered position.

FIG. 13 shows a pneumatically operated screw driver according to an eighth embodiment of this invention. This embodiment is similar to the sixth embodiment in terms of the concept of the integral operation valve 402 and the shut off valve 416 and in terms of use of the compressed air in the air chamber S1. However, the eighth embodiment does not provide vertical movement of the drive bit 103 but only provides rotation of the drive bit 103. A rotor 201 is rotatable by the pneumatic pressure applied from the air chamber S1. The rotation of the rotor 201 is transmitted to a gear 614 and a power transmission unit 604 to deceleratingly rotate the drive bit 103, the rotation of the drive bit 103 is terminated when the compressed air in the air chamber S1 is used up.

In the above described embodiments, a modification can be made for retarding rotation start timing of the blade portion so as to further reduce consumption of the compressed air. That is, it is possible to first moving down the moving unit, and then to start rotation of the drive bit together with the vertical movement of the moving unit.

For example, as one modified example to the first embodiment, the position of the piston 114*a* relative to the radial bores 101*e* is taken into consideration. That is, during initial downward travel of the piston 114*a*, the piston closes the radial bores 101*e* by increasing axial length of the piston 114*a*. Therefore, compressed air cannot be introduced into the blade portion 101*d*. During this period, the moving unit 114 is only downwardly moved toward the screw 13. However, upon the piston 114*a* is moved past the radial bores 101*e*, the compressed air can be introduced into the blade portion 101*d* through the air passage 107*a* for rotating the blade portion 101*d*. Thus, the drive bit 103 first performs composite rotational and axial movements for downwardly urging and rotating the screw 13.

Here, the rotation of the rotor 101 can not be started simultaneous with the downward movement of the moving unit 114, but the rotation of the rotor 101 is started at a timing where the drive bit 103 is positioned immediately above the screw 13. In other words, by suitably designing the relative position between the piston 114*a* and the radial bores 101*e*, idle rotation of the rotor 101 is avoidable as much as possible, to thereby further reduce consumption of the compressed air amount.

While the invention has been described in detail and with reference to specific embodiment thereof, it would be apparent to those skilled in the art that various changes and modifications may be made therein without departing from the spirit and scope of the invention.

What is claimed is:

1. A pneumatically operated screw driver connected to a compressed air source for driving a screw into a work-piece the screw driver comprising:

an outer frame (107, 207, 307, 407) formed with a compressed air inlet port (105);

a rotor (101) rotatably supported within the outer frame and axially fixed, and including a hollow space (101*a*) extending through said rotor in an axial direction thereof;

a moving unit (114) having a drive bit (103) coaxially engageable with a screw (13), the moving unit being slidably disposed within the hollow space so as to permit movement only in an axial direction relative to said rotor;

rotation transmitting means (114*b*, 114*b*') disposed between the rotor and the moving unit for transmitting rotation of the rotor to the moving unit while preventing relative rotational movement between said rotor and said moving unit; and means for selectively introducing pneumatic pressure to be rotor and the moving unit for pneumatically rotating the rotor about its axis and for moving the moving unit in the axial direction.

2. The pneumatically operated screw driver as claimed in claim 1, wherein the rotor comprises:

an upper sleeve portion (101*b*) rotatably supported by the outer frame;

a lower sleeve portion (101*c*) rotatably supported by the outer frame;

a blade portion (101*d*) positioned between the upper and lower sleeve portions and provided coaxially therewith, the upper and lower sleeve portions, corresponding groove being formed in the outer frame for receiving the blade portion, so that axial movement of the rotor is prevented.

3. The pneumatically operated screw driver as claimed in claim 2, wherein the moving unit comprises:

a piston (114*a*) slidably disposed relative to the hollow space, the hollow space of the rotor being divided by the piston;

a rod portion provided coaxially and integrally with the piston, the drive bit (103) being coaxially connected to a lower end of the rod portion, and the rotation transmitting means being provided at the rod portion, an annular space S being defined by an inner peripheral surface of the rotor and the outer peripheral surface of the rod portion.

4. The pneumatically operated screw driver as claimed in claim 3, wherein the pneumatic pressure introducing means comprises means for terminating introduction of the compressed air into the rotor and to the moving unit when the screw is completely screwed into the workpiece.

5. The pneumatically operated screw driver as claimed in claim 3, wherein the rod portion of the moving unit is provided with a flange, and the screw driver further comprising a biasing means interposed between a bottom wall of the lower sleeve portion and the flange for returning the moving unit to its original position.

6. A pneumatically operated screw driver connected to a compressed air source for driving a screw into a work-piece, the screw driver comprising:

an outer frame (107, 207, 307, 407) formed with a compressed air inlet port (105);

a rotor (101) rotatably supported within the outer frame, and including a hollow space (101*a*) extending through said rotor in an axial direction thereof;

a moving unit (114), having a drive bit (103) coaxially engageable with a screw (13) and movable in an axial direction thereof, the moving unit being slidably disposed within the hollow space;

rotation transmitting means (114*b*, 114*b*') disposed between the rotor and the moving unit for transmitting rotation of the rotor to the moving unit; and means for selectively introducing pneumatic pressure to the rotor and the moving unit for pneumatically rotating the rotor about its axis and for moving the moving unit in the axial direction, wherein the rotor comprises:

an upper sleeve portion (101*b*) rotatably supported by the outer frame;

a blade portion (101*d*) positioned between the upper and lower sleeve portions and provided coaxially therewith, a corresponding groove being formed in the outer frame for receiving the blade portion, so that axial movement of the rotor is prevented, wherein the moving unit comprises:

a piston (114*a*) extending through and slidably disposed within the hollow space;

a rod portion provided coaxially and integrally with the piston, the drive bit (103) being coaxially connected to a lower end of the rod portion, and the rotation transmitting means being provided at the rod portion, an annular space S being defined by an inner peripheral surface of the rotor and the outer peripheral surface of the rod portion, wherein the pneumatic pressure introducing means comprises:

means for terminating introduction of the compressed air into the rotor and to the moving unit when the screw is completely screwed into the workpiece, and wherein the frame is formed with an air chamber (S1), and the terminating means comprises:

an operation valve (102) movably disposed at the outer frame, the operation valve being movable to first and second positions;

a valve means (110, 111, 211) disposed above the rotor and movable between upper and lower positions, the valve means comprising a first valve (111, 211) having an upper pressure receiving surface (111*b*, 211*b*) and a lower pressure receiving surface seatable on the rotor, a fluid passage (143) being provided between the rotor and the first valve when the first valve is moved to the upper position, the fluid passage being communicable between the air chamber and the hollow space for introducing the compressed air in the air chamber into the hollow space through the fluid passage to lower the moving unit;

a first passage means (141) connected between the operation vale and the upper pressure receiving surface for applying pneumatic pressure to the upper pressure receiving surface to provide the lower position of the valve means in order to close the hollow space;

the first position of the operation valve providing fluid communication between the air chamber and the first passage means and the second position of the operation valve providing disconnection therebetween.

7. The pneumatically operated screw driver as claimed in claim 6, wherein the piston is formed with a communication passage (112) having one end opened to the upper hollow space and another end communicatable with the annular space.

8. The pneumatically operated screw driver as claimed in claim 7, further comprising a check valve (144) provided at the another end of the communication passage, the check valve allowing compressed air to flow from the upper hollow space into the annular space but preventing the compressed air from flowing from the annular space to the upper hollow space.

9. The pneumatically operated screw driver as claimed in claim 8, wherein the outer frame is formed with a second passage means (208) having one end directly communicatable with the air chamber and another end communicatable with the blade portion, the pneumatic pressure being introduced into the second passage means from the air chamber when the operation valve has the second position to provide the upper position of the first valve.

10. The pneumatically operated screw driver as claimed in claim 9, further comprises a time setting means (315) disposed at the first passage means for providing closure of the upper hollow space and the second passage means by the valve means when a predetermined time period is elapsed from a start of the screw driving operation.

11. The pneumatically operated screw driver as claimed in claim 10, wherein the time-setting means comprising:

a first piston chamber (326) connected to the operation valve through a throttle opening (316*a*) having a small diameter;

a second piston chamber (327) selectively communicatable (328) with the air chamber and selectively communicatable (329) with the operation valve and connected to the first passage means;

a first piston (318*a*) slidably disposed within the first piston chamber; and a second piston (318*b*) movably disposed within the second piston chamber, the second piston being connected to the first piston, the pneumatic pressure from the air chamber being applied to the first piston chamber to urge the first piston when the operation valve has the first position in order to shut off fluid communication between the air chamber and the second piston chamber, and the pneumatic pressure within the first piston chamber being gradually reduced when the operation valve has the second position for moving the second piston in order to provide fluid communication between the air chamber and the upper pressure receiving surface through the second piston chamber and the first passage means.

12. A pneumatically operated screw driver connected to a compressed air source for driving a screw into a work-piece, the screw driver comprising:

an outer frame (107, 207, 307, 407) formed with a compressed air inlet port (105);

a rotor (101) rotatably supported within the outer frame, and including a hollow space (101*a*) extending through said rotor in an axial direction thereof;

a moving unit (114), having a drive bit (103) coaxially engageable with a screw (13) and movable in an axial direction thereof, the moving unit being slidably disposed within the hollow space;

rotation transmitting means (114*b*, 114*b'*) disposed between the rotor and the moving unit for transmitting rotation of the rotor to the moving unit; and means for selectively introducing pneumatic pressure to the rotor and the moving unit for pneumatically rotating the rotor about its axis and for moving the moving unit in the axial direction, wherein the rotor comprises:

an upper sleeve portion (101*b*) rotatably supported by the outer frame;

a lower sleeve portion (101*c*) rotatably supported by the outer frame;

a blade portion (101*d*) positioned between the upper and lower sleeve portions and provided coaxially therewith, a corresponding groove being formed in the outer frame for receiving the blade portion, so that axial movement of the rotor is prevented, and wherein the rotor is formed of a material having a low specific gravity.

13. A pneumatically operated screw driver connected to a compressed air source for driving a screw into a work-piece, the screw driver comprising:

an outer frame (107, 207, 307, 407) formed with a compressed air inlet port (105);

a rotor (101) rotatably supported within the outer frame, and including a hollow space (101*a*) extending through said rotor in an axial direction thereof;

a moving unit (114), having a drive bit (103) coaxially engageable with a screw (13) and movable in an axial direction thereof, the moving unit being slidably disposed within the hollow space;

rotation transmitting means (114*b*, 114*b'*) disposed between the rotor and the moving unit for transmitting rotation of the rotor to the moving unit; and means for selectively introducing pneumatic pressure to the rotor and the moving unit for pneumatically rotating the rotor about its axis and for moving the moving unit in the axial direction, wherein the rotor comprises:

an upper sleeve portion (101*b*) rotatably supported by the outer frame;

a lower sleeve portion (101*c*) rotatably supported by the outer frame;

a blade portion (101*d*) positioned between the upper and lower sleeve portions and provided coaxially therewith, a corresponding groove being formed in the outer frame for receiving the blade portion, so that axial movement of the rotor is prevented, wherein the moving unit comprises:

a piston (114*a*) extending through and slidably disposed within the hollow space;

a rod portion provided coaxially and integrally with the piston, the drive bit (103) being coaxially connected to a lower end of the rod portion, and the rotation transmitting means being provided at the rod portion, an annular space S being defined by an inner peripheral surface of the rotor and the outer peripheral surface of the rod portion, wherein the pneumatic pressure introducing means comprises:

means for terminating introduction of the compressed air into the rotor and to the moving unit when the screw is completely screwed into the workpiece, and wherein the frame is formed with an air chamber (S1), and the terminating means comprises:

an operation valve (102) movably disposed at the outer frame, the operation valve being movable to first and second positions;

a valve means (11) connected to a top end of the rod portion of the piston (114*a*) for selectively closing a top open end of the hollow space (101*a*);

a first passage means (141) connected between the operation valve and the top open end of the hollow space;

the first position of the operation valve providing fluid communication between the air chamber and the first passage means and the second position of the operation valve providing disconnection therebetween;

the valve means (110) having a lower most position for closing the top open end when the operation valve is moved to the first position where hydraulic pressure within the air chamber is applied into the hollow space through the first passage means.

14. The pneumatically operated screw driver as claimed in claim 13, wherein the piston is formed with a communication passage (112) having one end opened to the upper hollow space and another end communicatable with the annular space.

15. The pneumatically operated screw driver as claimed in claim 14, further comprising a check valve (144) provided at the another end of the communication passage, the check valve allowing compressed air to flow from the upper hollow space into the annular space but preventing the compressed air from flowing from the annular space to the upper hollow space.

16. A pneumatically operated screw driver connected to a compressed air source for driving a screw into a work-piece, the screw driver comprising:

an outer frame (107, 207, 307, 407) formed with a compressed air inlet port (105);

a rotor (101) rotatably supported within the outer frame, and including a hollow space (101*a*) extending through said rotor in an axial direction thereof;

a moving unit (114), having a drive bit (103) coaxially engageable with a screw (13) and movable in an axial direction thereof, the moving unit being slidably disposed within the hollow space;

rotation transmitting means (114*b*, 114*b'*) disposed between the rotor and the moving unit for transmitting rotation of the rotor to the moving unit; and means for selectively introducing pneumatic pressure to the rotor and the moving unit for pneumatically rotating the rotor about its axis and for moving the moving unit in the axial direction; and means for retarding rotation of the rotor after the moving unit is moved in the axial direction.

17. The pneumatically operated screw driver as claimed in claim 16, wherein the rotor comprises:

an upper sleeve portion (101*b*) rotatably supported by the outer frame;

a lower sleeve portion (101*c*) rotatably supported by the outer frame;

a blade portion (101*d*) positioned between the upper and lower sleeve portions and provided coaxially therewith, the blade portion having a diameter greater than that of the upper and lower sleeve portions, a corresponding groove being formed in the outer frame for receiving the blade portion, so that axial movement of the rotor is prevented.

18. The pneumatically operated screw driver as claimed in claim 17, wherein the moving unit comprises:

a piston (114*a*) extending through and slidably disposed within the hollow space;

a rod portion provided coaxially and integrally with the piston, the drive bit (103) being coaxially connected to a lower end of the rod portion, and the rotation transmitting means being provided at the rod portion, an annular space (S) being defined by an inner peripheral surface of the rotor and the outer peripheral surface of the rod portion.

19. The pneumatically operated screw driver as claimed in claim 18, wherein the retarding means comprises:

an outer peripheral surface of the piston (114*a*); and a passage means 107(*a*) communicatable between the hollow space and the blade portion; the passage means having an open end opening at the hollow space, the open end being closed by the outer peripheral surface for a predetermined period of time after the moving instrument is moved in the axial direction.

20. A pneumatically operated screw driver connected to a compressed air source for driving a screw into a work-piece, the screw driver comprising:

an outer frame (107, 207, 307, 407) formed with a compressed air inlet port (105);

a rotor (101) rotatably supported within the outer frame, and including a hollow space (101*a*) extending through said rotor in an axial direction thereof;

a moving unit (114), having a drive bit (103) coaxially engageable with a screw (13) and movable in an axial direction thereof, the moving unit being slidably disposed within the hollow space;

rotation transmitting means (114*b*, 114*b'*) disposed between the rotor and the moving unit for transmitting rotation of the rotor to the moving unit; and means for selectively introducing pneumatic pressure to the rotor and the moving unit for pneumatically rotating the rotor about its axis and for moving the moving unit in the axial direction, wherein the pneumatic pressure introducing means comprises;

means for terminating introduction of the compressed air into the rotor and to the moving unit when the screw is completely screwed into the workpiece.

21. The pneumatically operated screw driver as claimed in claim 20, wherein the rotor comprises:

an upper sleeve portion (101*b*) rotatably supported by the outer frame;

a lower sleeve portion (101*c*) rotatably supported by the outer frame;

a blade portion (101*d*) positioned between the upper and lower sleeve portions and provided coaxially therewith, the blade portion having a diameter greater than that of the upper and lower sleeve portions, a corresponding groove being formed in the outer frame for receiving the blade portion, so that axial movement of the rotor is prevented.

22. The pneumatically operated screw driver as claimed in claim 21, wherein the terminating means comprises a valve means (110) disposed above the moving unit and provided coaxially and integrally therewith for closing an upper open end of the upper sleeve portion when the moving unit is moved to its lowermost position.

23. The pneumatically operated screw driver as claimed in claim 22, wherein the moving unit comprises:

a piston (114*a*) extending through and slidably disposed relative to the hollow space;

a rod portion provided coaxially and integrally with the piston, the drive bit (103) being coaxially connected to a lower end of the rod portion, and the rotation transmitting means being provided at the rod portion, an annular space (S) being defined by an inner peripheral surface of the rotor and the outer peripheral surface of the rod portion, the valve means being integrally connected to an upper end of the rod portion.

* * * * *